US012484665B2

(12) United States Patent
Suzuki et al.

(10) Patent No.: US 12,484,665 B2
(45) Date of Patent: Dec. 2, 2025

(54) UPPER AND SHOE INCLUDING THE SAME

(71) Applicant: ASICS CORPORATION, Hyogo (JP)

(72) Inventors: Chihaya Suzuki, Hyogo (JP); Fumitaka Kamifukumoto, Hyogo (JP); Kazuki Ohkoshi, Hyogo (JP)

(73) Assignee: ASICS CORPORATION, Hyogo (JP)

( * ) Notice: Subject to any disclaimer, the term of this patent is extended or adjusted under 35 U.S.C. 154(b) by 81 days.

(21) Appl. No.: 18/266,502

(22) PCT Filed: Dec. 23, 2020

(86) PCT No.: PCT/JP2020/048286
§ 371 (c)(1),
(2) Date: Jun. 9, 2023

(87) PCT Pub. No.: WO2022/137407
PCT Pub. Date: Jun. 30, 2022

(65) Prior Publication Data
US 2024/0023673 A1 Jan. 25, 2024

(51) Int. Cl.
*A43B 23/02* (2006.01)
*A43B 23/04* (2006.01)

(52) U.S. Cl.
CPC ..... *A43B 23/0245* (2013.01); *A43B 23/04* (2013.01)

(58) Field of Classification Search
CPC .. A43C 1/00; A43C 1/04; A43C 1/006; A43C 5/00; A43C 7/00; A43C 11/004; A43C 11/16; A43B 23/04; A43B 23/0245; A43B 23/26; A43B 13/38; A43B 5/14
See application file for complete search history.

(56) References Cited

U.S. PATENT DOCUMENTS

| | | | | |
|---|---|---|---|---|
| 6,052,921 | A | 4/2000 | Oreck | |
| 8,490,299 | B2 | 7/2013 | Dua et al. | |
| 9,545,128 | B2 * | 1/2017 | Podhajny | A43B 1/04 |
| 9,743,709 | B2 * | 8/2017 | Hesterberg | A43B 13/16 |
| 9,848,672 | B2 | 12/2017 | Podhajny | |

(Continued)

FOREIGN PATENT DOCUMENTS

| | | | | |
|---|---|---|---|---|
| CN | 102271548 A | | 12/2011 | |
| CN | 105188442 A | | 12/2015 | |
| CN | 118766186 A | * | 10/2024 | A43C 1/02 |
| JP | H09-509594 A | | 9/1997 | |

(Continued)

OTHER PUBLICATIONS

Extended European Search Report issued for the corresponding European patent Application No. 20966897.9 on Nov. 24, 2023.

(Continued)

*Primary Examiner* — Khoa D Huynh
*Assistant Examiner* — Giao QT Hoang
(74) *Attorney, Agent, or Firm* — Rimon P.C.

(57) ABSTRACT

An upper includes an upper main body covering an instep of a foot. The upper main body is formed with a partial region that is a region away from an outer edge of the upper main body, and a passage formed in a tubular shape that extends from the partial region toward the outer edge and then extends so as to return to the partial region and allows a shoelace to pass through. An opening extending in a front-back direction is formed in the partial region. The passage extends from the opening toward the outer edge and then extends so as to return to the opening.

7 Claims, 12 Drawing Sheets

(56) References Cited

U.S. PATENT DOCUMENTS

| | | | | |
|---|---|---|---|---|
| 2004/0159017 | A1* | 8/2004 | Martin | A43C 1/00 36/50.5 |
| 2004/0181972 | A1* | 9/2004 | Csorba | A43B 23/0265 36/50.1 |
| 2010/0154256 | A1* | 6/2010 | Dua | A43B 7/20 12/146 B |
| 2014/0150292 | A1 | 6/2014 | Podhajny et al. | |
| 2014/0196311 | A1* | 7/2014 | Follet | D04B 21/20 428/174 |
| 2014/0245634 | A1 | 9/2014 | Podhajny | |
| 2016/0206044 | A1* | 7/2016 | Dimoff | A43C 1/04 |
| 2019/0174870 | A1* | 6/2019 | Beers | A43B 3/44 |
| 2020/0037708 | A1 | 2/2020 | Bruce et al. | |
| 2020/0138145 | A1* | 5/2020 | Greenspan | A43C 1/003 |
| 2020/0170347 | A1* | 6/2020 | Huffman | A43B 7/28 |

FOREIGN PATENT DOCUMENTS

| | | | |
|---|---|---|---|
| JP | 2007-190351 | A | 8/2007 |
| JP | 2012-512698 | A | 6/2012 |
| JP | 2015-536207 | A | 12/2015 |
| JP | 2016-516458 | A | 6/2016 |
| WO | 2015/038243 | A1 | 3/2015 |

OTHER PUBLICATIONS

Notice of Reasons for Refusal issued for the corresponding Japanese Patent Application No. 2022-570867 mailed on Mar. 26, 2024.
International Search Report issued in corresponding International Patent Application No. PCT/JP2020/048286, filled Mar. 23, 2021, with English translation.
Office Action dated Mar. 31, 2025, from corresponding Chinese Application No. 202080107970.5, 13 pages.

* cited by examiner

UPPER AND SHOE INCLUDING THE SAME

CROSS-REFERENCE OF RELATED APPLICATIONS

This application is the U.S. National Phase under 35 U.S.C. § 371 of International Patent Application No. PCT/JP2020/048286, filed on Dec. 23, 2020, the entire disclosure of which Application is incorporated by reference herein.

FIELD

The present invention relates to an upper and a shoe including the same.

BACKGROUND

Conventionally, a large number of shoes in which an upper is brought into close contact with the foot by tensioning a shoelace have been developed and brought into practical use. For example, Patent Literature 1 discloses an invention in which, in an upper in which a foot insertion opening for inserting a foot of a wearer, an opening communicating with the foot insertion opening and extending forward from the foot insertion opening, and a plurality of holes provided at left and right side edges of the opening and separated in a fore-rear direction are formed, a shoelace is alternately passed through left and right holes. In the invention disclosed in Patent Literature 1, the upper can be brought into close contact with the foot by tensioning the shoelace passed through the left and right holes.

CITATION LIST

Patent Literature

Patent Literature 1: JP 2007-190351 A

SUMMARY

Technical Problem

The tightening force to the upper generated by tensioning the shoelace is stronger as it is closer to the portion of the upper through which the shoelace passes, and thus, in the structure in which the shoelace passes through the holes of the left and right side edges as in the invention disclosed in Patent Literature 1, the tightening force is applied around the left and right side edges of the opening. However, it may be desired to tighten the upper by applying the tightening force to portions other than the left and right side edges of the opening.

The present invention has been made in view of the above, and an object thereof is to obtain an upper capable of increasing the degree of freedom in selecting a portion through which a shoelace passes and simultaneously pulling up the upper from the sole side.

Solution to Problem

In order to solve the above problem and achieve the object, an upper, comprising: an upper main body covering an instep of a foot, wherein the upper main body is formed with a partial region that is a region away from an outer edge of the upper main body, and a passage formed in a tubular shape that extends from the partial region toward the outer edge and then extends so as to return to the partial region and allows a shoelace to pass through.

Advantageous Effects of Invention

An upper according to the present invention has an effect that the degree of freedom in selecting a portion through which a shoelace passes can be increased, and at the same time, the upper can be pulled up from the sole side.

DESCRIPTION OF EMBODIMENTS

Figure 1:
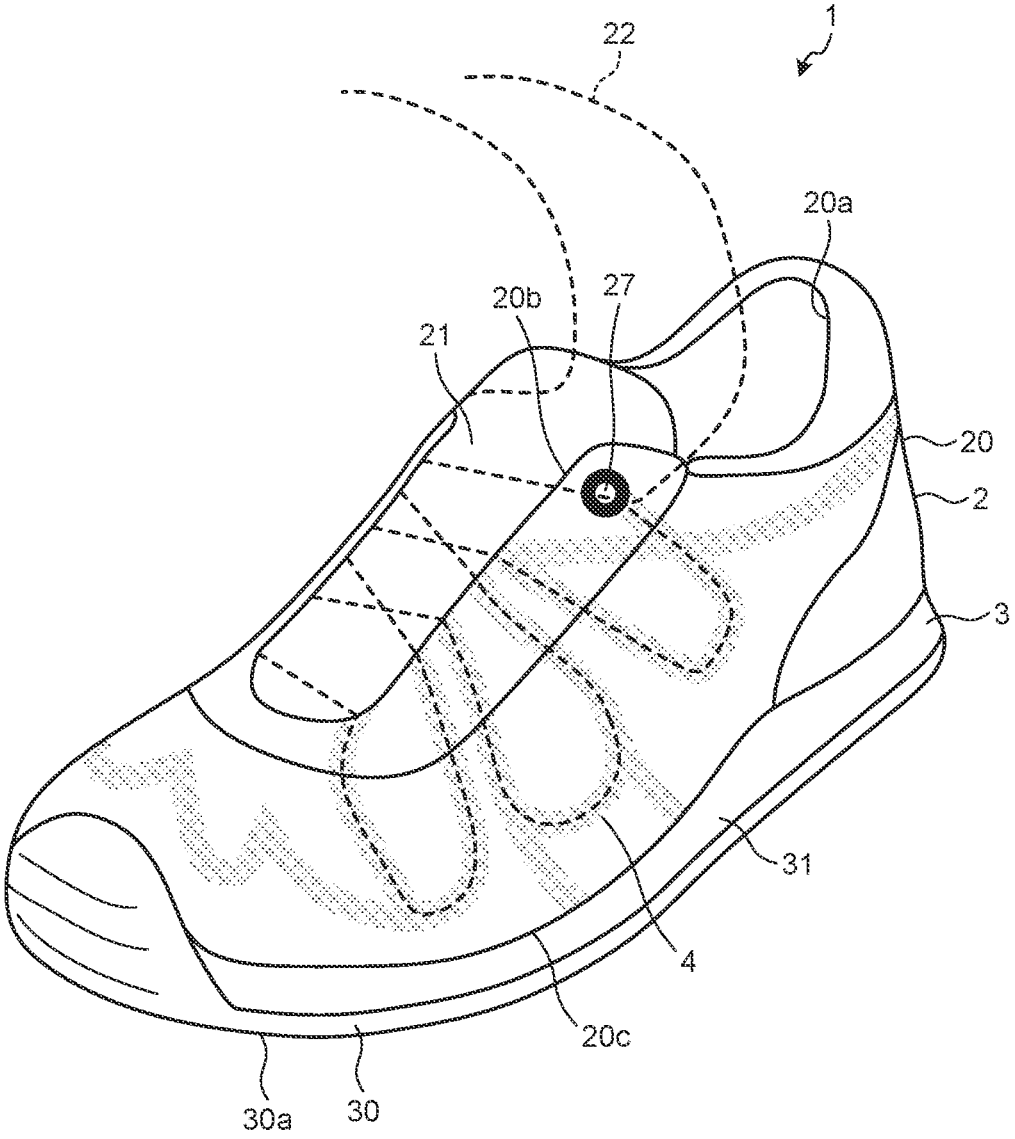
FIG. 1 is a perspective view of a shoe according to a first embodiment of the present invention.

Hereinafter, embodiments of an upper according to the present invention and a shoe including the same will be described in detail with reference to the drawings. Note that the present invention is not limited by the examples.

In the embodiment described below, a direction in which a shoe center axis, which is a perpendicular line passing through the center of the shoe in a plan view of the shoe, extends is referred to as a fore-rear direction, and a direction orthogonal to a fore-rear direction in a plan view of the shoe is referred to as a left-right direction.

Further, in the fore-rear direction, a direction from a terminal on a side where a portion covering the rear foot portion of the upper foot is located toward a terminal on a side where the portion covering the fore foot portion of the upper foot is located is referred to as fore, and in the fore-rear direction, a direction from a terminal on a side where the portion covering the fore foot portion of the upper foot is located toward a terminal on a side where the portion covering the rear foot portion of the upper foot is located is referred to as rear.

In addition, a median side in an anatomical normal position of the foot is referred to as the medial foot side, and a side opposite to the median side in the anatomical normal position of the foot is referred to as the lateral foot side. That is, a side closer to the median line in the anatomical normal position is referred to as the medial foot side, and a side farther from the median line in the anatomical normal position is referred to as the lateral foot side.

In addition, when a line along the left-right direction passing through a position corresponding to 30% of a dimension in the fore-rear direction of the upper from a fore end of the upper is assumed as a first boundary line, and a line along the left-right direction passing through a position corresponding to 80% of the dimension in the fore-rear direction of the upper from the fore end of the upper is assumed as a second boundary line, a portion positioned forward of the first boundary line is referred to as an upper fore foot portion, a portion interposed between the first boundary line and the second boundary line is referred to as an upper middle foot portion, and a portion positioned rearward of the second boundary line is referred to as an upper rear foot portion.

The upper fore foot portion corresponds to a portion covering a fore foot portion of the foot of the wearer having a standard body shape, the upper middle foot portion corresponds to a portion covering a middle foot portion of the foot of the wearer having the standard body shape, and the upper rear foot portion corresponds to a portion covering a rear foot portion of the foot of the wearer having the standard body shape. That is, the first boundary line is a line substantially along the MP joints of the wearer with the standard body shape, and the second boundary line is a line substantially along the Chopart joint of the wearer with the standard body shape.

Furthermore, a height direction means a direction orthogonal to both the fore-rear direction and the left-right direction unless otherwise specified, and a thickness means a dimension in the height direction unless otherwise specified.

First Embodiment

FIG. 1 is a perspective view of a shoe 1 according to a first embodiment of the present invention. FIG. 1 illustrates only a shoe 1 for a left foot. Since the shoe 1 has a bilaterally symmetrical structure for the left foot and the right foot, only the shoe 1 for the left foot is described in the present embodiment, and the description of the shoe 1 for the right foot is omitted. The shoe 1 is, for example, a shoe for running, walking, or climbing, or a shoe for sports such as tennis and basketball. The shoe 1 includes an upper 2 and a sole 3 located below the upper 2. The upper 2 mainly covers a portion on the instep side of the foot. The sole 3 covers the sole.

The upper 2 includes an upper main body 20, a shoe tongue 21, and a shoelace 22.

The upper main body 20 mainly covers a portion on the instep side of the foot. A foot insertion opening 20*a* for inserting the foot of the wearer and an opening 20*b* communicating with the foot insertion opening 20*a* and extending forward from the foot insertion opening 20*a* are formed at an upper portion of the upper main body 20. A region of the upper main body 20 where the opening 20*b* is formed is a partial region that is a region away from the outer edge 20*c* of the upper main body 20. The outer edge 20*c* of the upper main body 20 is an edge located on the outermost periphery when the upper main body 20 in the assembled state is viewed in a plan view. In the upper main body 20, there is formed a passage 4 formed in a tubular shape that extends from the opening 20*b* toward the outer edge 20*c* and then extends so as to return to the opening 20*b* and allows the shoelace 22 to pass through. Note that the passage 4 may be formed to be visible from the outside of the upper main body 20 or may be formed to be invisible from the outside of the upper main body 20, but in each drawing, the passage 4 is illustrated by dot hatching for easy understanding.

The shoe tongue 21 is a member for protecting the instep of the foot of the wearer. The shoe tongue 21 covers the opening 20*b* inside the upper main body 20. The shoe tongue 21 is fixed to the upper main body 20 by stitching, welding, bonding, or a combination thereof. As a material of the upper main body 20 and the shoe tongue 21, for example, a woven fabric, a knitted fabric, synthetic leather, or resin is used. In particular, in the shoe 1 in which air permeability and a lightweight property are required, it is preferable to use a double raschel warp knitted fabric knitted with a polyester yarn as the material of the upper main body 20 and the shoe tongue 21. Note that the materials of the upper main body 20 and the shoe tongue 21 are not limited to the exemplified materials.

The shoelace 22 is a string-like member passed through the passage 4 of the upper main body 20, and is detachably attached to the upper main body 20. Note that the shoelace 22 includes a portion that is visible from the outside of the upper main body 20 and a portion that is invisible from the outside, in each drawing, the entire shoelace 22 is illustrated by a broken line for easy understanding.

The sole 3 includes an outsole 30 and a midsole 31. The sole 3 is fixed to the upper 2 by stitching, welding, bonding or a combination thereof. A lower surface of the outsole 30 is a ground contact surface 30*a* to be contacted on the ground. The midsole 31 is located on an upper surface of the outsole 30 and has a cushioning property. Note that the outsole 30 may be integrated with the midsole 31. The midsole 31 in which the outsole 30 is integrated is also referred to as a "unisole".

Figure 2:
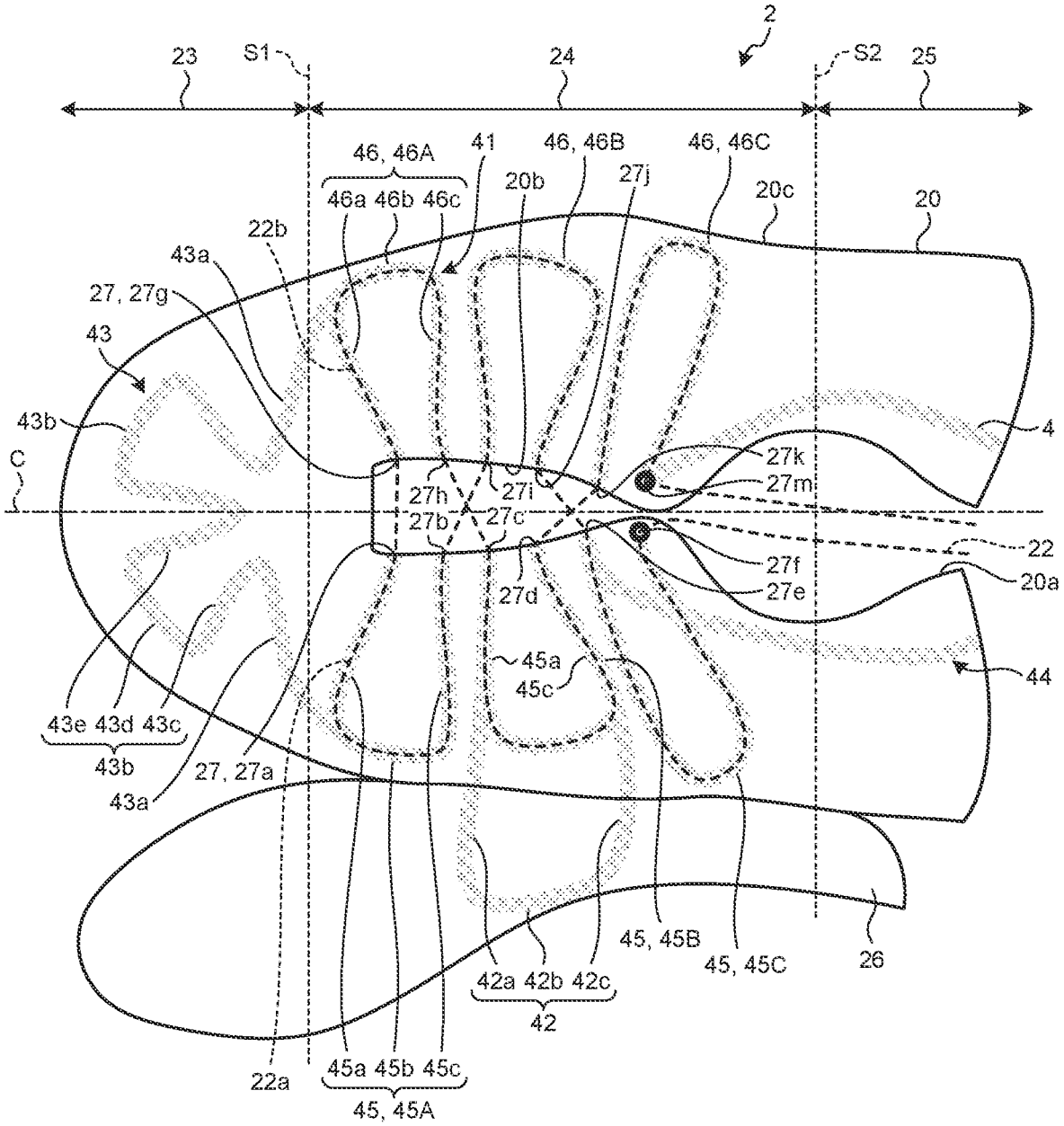
FIG. 2 is a developed view of an upper according to the first embodiment.
Figure 3:
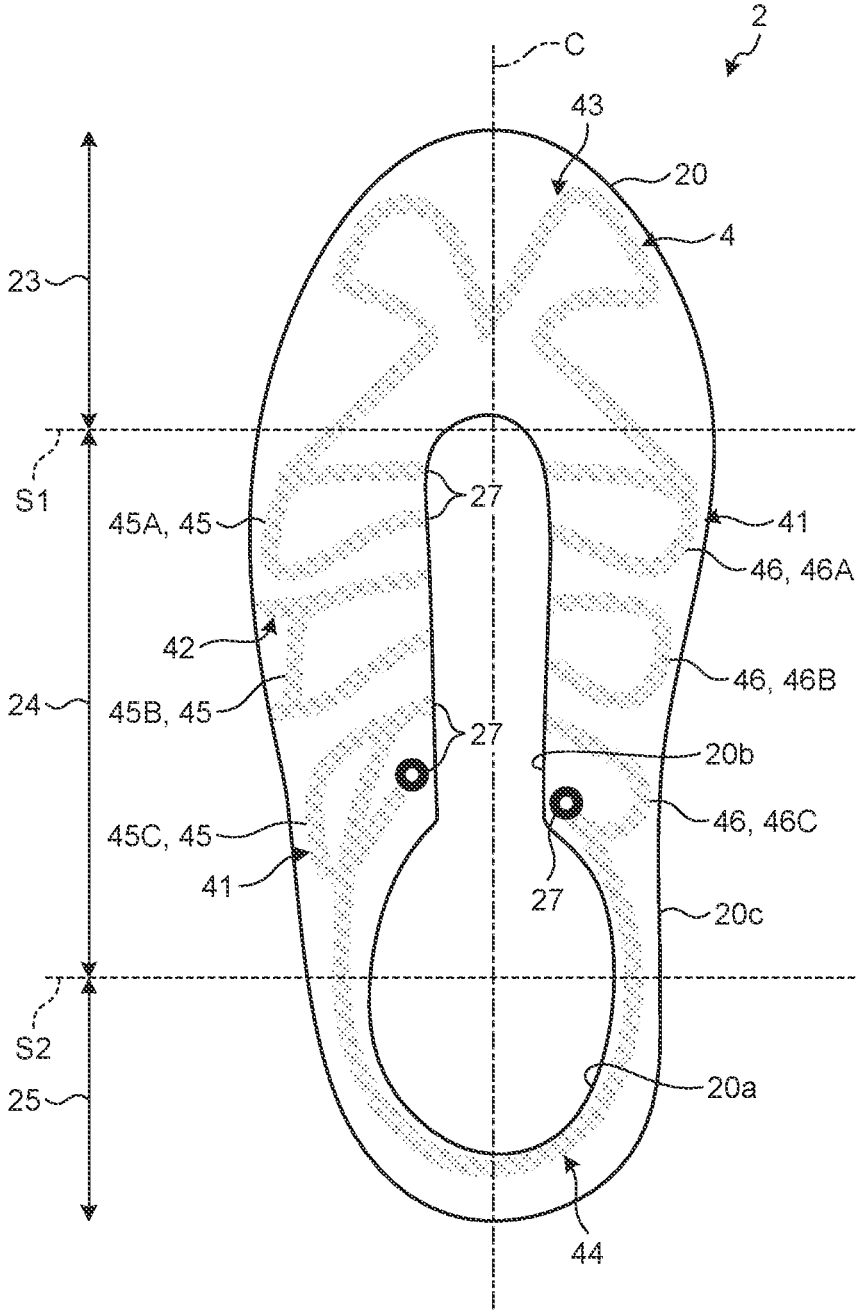
FIG. 3 is a top view of the upper according to the first embodiment.
Figure 4:
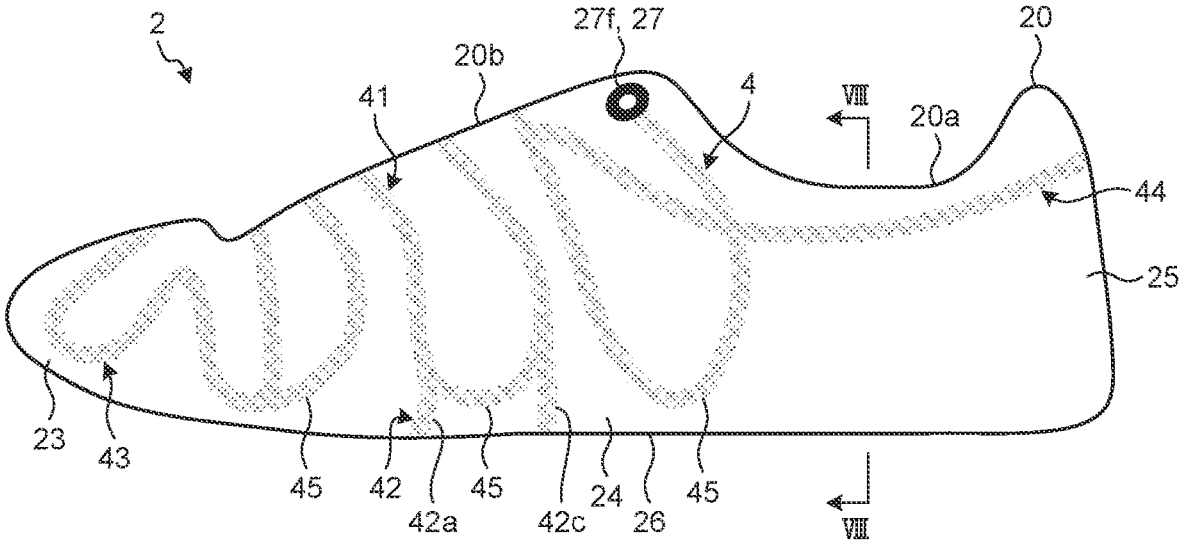
FIG. 4 is a side view of an lateral foot side of the upper according to the first embodiment.
Figure 5:
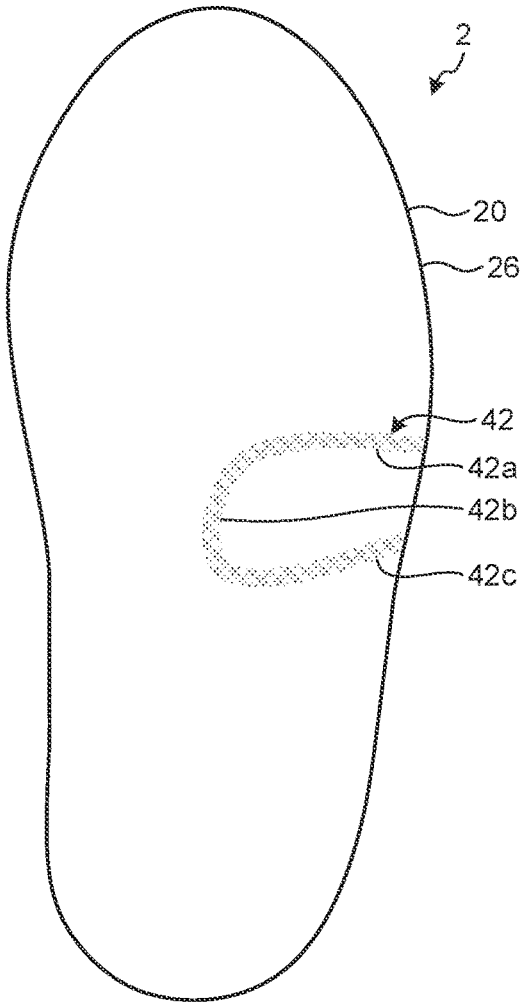
FIG. 5 is a bottom view of the upper according to the first embodiment.
Figure 6:
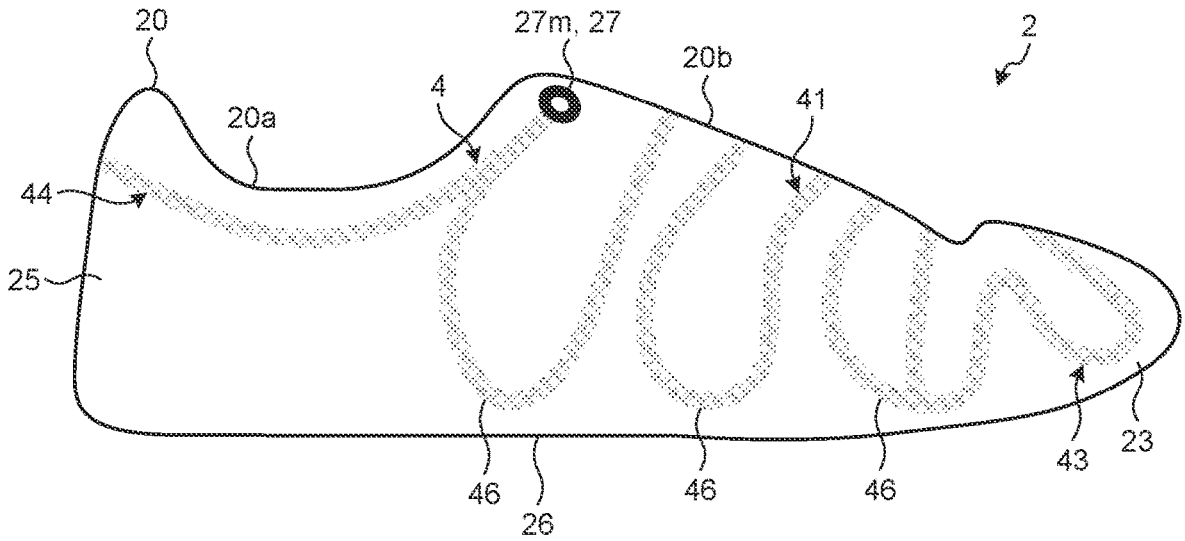
FIG. 6 is a side view of an medial foot side of the upper according to the first embodiment.
Figure 7:
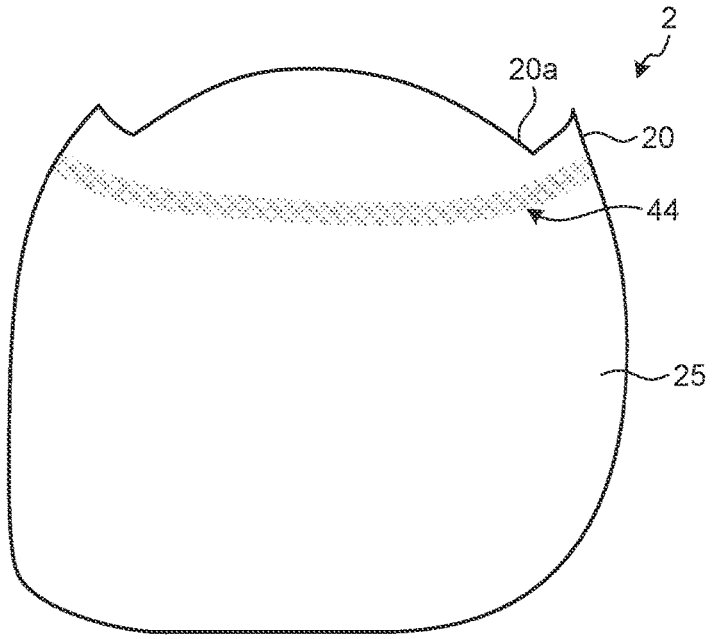
FIG. 7 is a rear view of the upper according to the first embodiment.

Next, a configuration of the upper main body 20 will be described in more detail with reference to FIGS. 2 to 7. FIG. 2 is a developed view of the upper 2 according to the first embodiment. FIG. 3 is a top view of the upper 2 according to the first embodiment. FIG. 4 is a side view of a lateral foot side of the upper 2 according to the first embodiment. FIG. 5 is a bottom view of the upper 2 according to the first embodiment. FIG. 6 is a side view of a medial foot side of the upper 2 according to the first embodiment. FIG. 7 is a rear view of the upper 2 according to the first embodiment.

As illustrated in FIGS. 2 and 3, the upper main body 20 includes an upper fore foot portion 23 that is the portion covering the fore foot portion of the foot of the wearer having the standard body shape, an upper middle foot portion 24 that is the portion covering the middle foot portion of the foot of the wearer having the standard body shape, an upper rear foot portion 25 that is the portion covering the rear foot portion of the foot of the wearer having the standard body shape, and an upper sole portion 26 that is a portion covering a sole of the wearer having the standard body shape. The upper fore foot portion 23, the upper middle foot portion 24, and the upper rear foot portion 25 are connected in this order in the fore-rear direction from the fore of the upper main body 20. The upper fore foot portion 23 is located in fore of the first boundary line S1. The upper middle foot portion 24 is located at a portion interposed between the first boundary line S1 and the second boundary line S2. The upper rear foot portion 25 is located behind the second boundary line S2. The upper fore foot portion 23 is formed continuously with the upper middle foot portion 24. The upper rear foot portion 25 is formed continuously with the upper middle foot portion 24. The upper sole portion 26 is formed continuously with the upper middle foot portion 24. The upper sole portion 26 is connected to a lower edge of the upper middle foot portion 24 on the lateral foot side. The upper sole portion 26 is a middle sole that covers a lower opening formed by being surrounded by a lower edge of the upper fore foot portion 23, a lower edge of the upper middle foot portion 24, and a lower edge of the upper rear foot portion 25. The upper sole portion 26 is fixed to an upper surface of the midsole 31 illustrated in FIG. 1 by adhesion or welding. Note that the shoe 1 may include a footbed. If the shoe 1 includes a footbed, the footbed is installed on the upper sole portion 26 inside the upper 2.

As illustrated in FIG. 2, the opening 20*b* is provided in a part of the upper middle foot portion 24. The opening 20*b* extends in the fore-rear direction at the center in the left-right direction of the upper middle foot portion 24. The upper main body 20 is formed with a plurality of communication portions 27*a* to 27*m* that communicates the inside and the outside of the passage 4. Hereinafter, each of the plurality of communication portions 27*a* to 27*m* may be referred to as a communication portion 27 without distinction. The plurality of communication portions 27 is provided separately from each other in the fore-rear direction at the left and right side edges of the opening 20*b*. The number of the communication portions 27 is not particularly limited, but in the present embodiment, six communication portions are provided at each of the left and right side edges of the opening 20*b*. The communication portion 27*a*, the communication portion 27*b*, the communication portion 27*c*, the communication portion 27*d*, the communication portion 27*e*, and the communication portion 27*f* are disposed at a side edge of the opening 20*b* on the lateral foot side in order from the fore. At a side edge on the medial foot side of the opening 20*b*, the communication portion 27*g*, the communication portion 27*h*, the communication portion 27*i*, the communication portion 27*j*, the communication portion 27*k*, and the communication portion 27*m* are disposed in order from the fore.

The configuration of the communication portion 27 is not particularly limited as long as the inside and the outside of the passage 4 can communicate with each other, but in the present embodiment, the communication portion is formed by extending the passage 4 to the opening 20*b*, or formed by an eyelet hole penetrating the upper main body 20 in the vertical direction. In the present embodiment, the communication portions 27*f* and 27*m* located rearmost in the left and right side edges of the opening 20*b* are formed by eyelet holes, and remaining communication portions 27 are formed by the passage 4 extending to the opening 20*b*.

The passage 4 includes a middle foot side passage 41, a sole side passage 42, a fore foot side passage 43, and a rear foot side passage 44.

The middle foot side passage 41 is a passage that extends from any one of the plurality of communication portions 27 toward the upper sole portion 26 and then extends to another of the communication portions 27. The middle foot side passage 41 extends substantially in a U shape. The middle foot side passage 41 includes a plurality of lateral foot side passages 45 formed on the lateral foot side with the opening 20*b* interposed therebetween, and a plurality of medial foot side passages 46 formed on the medial foot side with the opening 20*b* interposed therebetween. The lateral foot side passage 45 and the medial foot side passage 46 have bilaterally symmetrical shapes.

The number of the lateral foot side passages 45 is not particularly limited, but is three in the present embodiment. The three lateral foot side passages 45 are disposed at intervals in the fore-rear direction. Hereinafter, when the three lateral foot side passages 45 are distinguished, they are referred to as a lateral foot side passage 45A, a lateral foot side passage 45B, and a lateral foot side passage 45C in order from the fore. Each of the lateral foot side passages 45 includes a first lateral foot side passage 45*a* extending from one communication portion 27 toward the upper sole portion 26, a second lateral foot side passage 45*b* extending rearward from an end portion of the first lateral foot side passage 45*a* facing the upper sole portion 26, and a third lateral foot side passage 45*c* extending from a rear end portion of the second lateral foot side passage 45*b* toward the opening 20*b* to another communication portion 27. The third lateral foot side passage 45*c* is connected to the communication portion 27 located immediately behind the communication portion 27 connected to the first lateral foot side passage 45*a*. That is, the lateral foot side passage 45 connects the two communication portions 27 adjacent to each other in the fore-rear direction.

The number of the medial foot side passages 46 is not particularly limited, but is three in the present embodiment. The three medial foot side passages 46 are disposed at intervals in the fore-rear direction. Hereinafter, when the three medial foot side passages 46 are distinguished, they are referred to as a medial foot side passage 46A, a medial foot side passage 46B, and a medial foot side passage 46C in order from the fore. Each of the medial foot side passages 46 includes a first medial foot side passage 46*a* extending from one communication portion 27 toward the upper sole portion 26, a second medial foot side passage 46*b* extending rearward from an end portion of the first medial foot side passage 46*a* facing the upper sole portion 26, and a third medial foot side passage 46*c* extending from a rear end portion of the second medial foot side passage 46*b* toward the opening 20*b* to another communication portion 27. The third medial foot side passage 46*c* is connected to the communication portion 27 located immediately behind the communication portion 27 connected to the first medial foot side passage 46*a*. That is, the medial foot side passage 46 connects the two communication portions 27 adjacent to each other in the fore-rear direction.

The sole side passage 42 is a passage that extends from the lateral foot side passage 45 of the middle foot side passage 41 to the upper sole portion 26 and then extends so as to return to the lateral foot side passage 45 of the middle foot side passage 41. The sole side passage 42 extends substantially in a U shape. The sole side passage 42 is provided across the upper middle foot portion 24 and the upper sole portion 26. The sole side passage 42 is connected to the lateral foot side passage 45 located at the center in the fore-rear direction among the three lateral foot side passages 45 in the present embodiment. A portion of the sole side passage 42 formed in the upper sole portion 26 is disposed in a middle foot portion of the upper sole portion 26.

The sole side passage 42 includes a first sole side passage 42*a* extending from the first lateral foot side passage 45*a* to the upper sole portion 26, a second sole side passage 42*b* extending rearward from an end portion of the first sole side passage 42*a* located at the upper sole portion 26, and a third sole side passage 42*c* extending from a rear end portion of the second sole side passage 42*b* to the third lateral foot side passage 45*c*. As illustrated in FIG. 4, a portion of the first sole side passage 42*a* and a portion of the third sole side passage 42*c* extend in the vertical direction in the upper middle foot portion 24. As illustrated in FIG. 5, a remaining portion of the first sole side passage 42*a* and a remaining portion of the third sole side passage 42*c* extend in the left-right direction in the upper sole portion 26. The second sole side passage 42*b* extends in the fore-rear direction at the upper sole portion 26.

As illustrated in FIG. 2, the fore foot side passage 43 is a passage that extends from the middle foot side passage 41 to the upper fore foot portion 23 and then extends so as to return to the middle foot side passage 41. Specifically, the fore foot side passage 43 extends from the lateral foot side passage 45A located at the foremost position to the upper fore foot portion 23, and then passes through the vicinity of the toe of the upper fore foot portion 23 to extend to the medial foot side passage 46A located at the foremost position. The fore foot side passage 43 includes two first fore foot side passages 43*a* and two second fore foot side passages 43*b*.

The two first fore foot side passages 43*a* are provided at symmetrical positions across a shoe center axis C. The first fore foot side passage 43*a* located on the lateral foot side extends so as to be located on the medial foot side as it goes forward from the boundary between the first lateral foot side passage 45*a* and the second lateral foot side passage 45*b* of the lateral foot side passage 45A. The first fore foot side passage 43*a* located on the medial foot side extends so as to be located on the lateral foot side as it goes forward from the boundary between the first medial foot side passage 46*a* and the second medial foot side passage 46*b* of the medial foot side passage 46A.

The two second fore foot side passages 43*b* are provided side by side in the left-right direction in fore of the opening 20*b*. The second fore foot side passage 43*b* extends in a substantially U shape. Each of the second fore foot side passages 43*b* includes a first partial passage 43*c* extending so as to be away from the shoe center axis C from a distal end portion of the first fore foot side passage 43*a* toward the fore, a second partial passage 43*d* extending so as to approach the shoe center axis C from a distal end portion of the first partial passage 43*c* toward the fore, and a third partial passage 43*e* extending so as to approach the shoe center axis C from a distal end portion of the second partial passage 43*d* toward the rear. The distal end portions of the third partial passages 43*e* of the two second fore foot side passages 43*b* are connected to each other.

As illustrated in FIG. 3, the rear foot side passage 44 extends in a substantially U shape. The rear foot side passage 44 is a passage that extends from the middle foot side passage 41 to the upper rear foot portion 25 and then extends so as to return to the middle foot side passage 41. Specifically, the rear foot side passage 44 extends from the lateral foot side passage 45C located at the rearmost position to the upper rear foot portion 25, and then extends to the medial foot side passage 46C located at the rearmost position through a heel portion of the upper rear foot portion 25. One end portion along the length direction of the rear foot side passage 44 is connected to the vicinity of a portion communicating with the second communication portion 27 from the rear in the lateral foot side passage 45C. The other end portion along the length direction of the rear foot side passage 44 is connected to the vicinity of a portion communicating with the first communication portion 27 from the rear in the medial foot side passage 46C. As illustrated in FIGS. 4, 6, and 7, the rear foot side passage 44 is provided at a position closer to the foot insertion opening 20*a* than the center of the upper rear foot portion 25 in the vertical direction.

Figure 8:
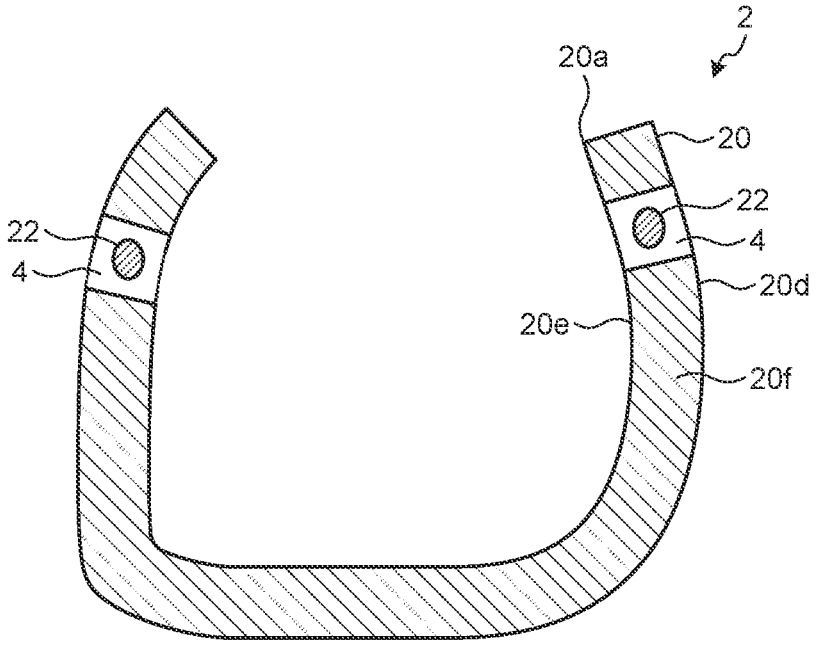
FIG. 8 is a cross-sectional view taken along line VIII-VIII illustrated in FIG. 4.

FIG. 8 is a cross-sectional view taken along line VIII-VIII illustrated in FIG. 4. As illustrated in FIG. 8, the upper main body 20 includes a first layer 20*d* facing the outside of the upper main body 20, a second layer 20*e* disposed at a distance from the first layer 20*d* and facing the inside of the upper main body 20, and a third layer 20*f* connecting the first layer 20*d* and the second layer 20*e*. The first layer 20*d*, the second layer 20*e*, and the third layer 20*f* are integrally formed by a single material. In the upper main body 20, there are a portion where the third layer 20*f* is provided and a portion where the third layer 20*f* is not provided. In the present embodiment, a portion where the third layer 20*f* is not provided is the passage 4. That is, the passage 4 is formed by not providing the third layer 20*f* in a part of the upper main body 20.

As illustrated in FIG. 2, the shoelace 22 passes through all the lateral foot side passages 45 and all the medial foot side passages 46. The shoelace 22 alternately passes through the lateral foot side passage 45 and the medial foot side passage 46. The shoelace 22 includes a first portion 22*a* passing through the lateral foot side passage 45A, the medial foot side passage 46B, and the lateral foot side passage 45C, and a second portion 22*b* passing through the medial foot side passage 46A, the lateral foot side passage 45B, and the medial foot side passage 46C.

One end portion along the length direction of the first portion 22*a* and one end portion along the length direction of the second portion 22*b* are connected to each other between the two communication portions 27*a* and 27*g*. A portion of the first portion 22*a* and a portion of the second portion 22*b* extend in the left-right direction across the opening 20*b*. The portions of the first portion 22*a* and the second portion 22*b* that cross the opening 20*b* are exposed to the outside of the upper main body 20. The other end portion along the length direction of the first portion 22*a* is exposed to the outside of the upper main body 20 from the communication portion 27*f* located rearmost on the lateral foot side. The other end portion along the length direction of the second portion 22*b* is exposed to the outside of the upper main body 20 from the communication portion 27*m* located rearmost on the medial foot side. Although not illustrated, the other end portion along the length direction of the first portion 22*a* and the other end portion in the length direction of the second portion 22*b* are tied in a bow knot or the like.

Next, effects of the upper 2 according to the present embodiment will be described.

In the present embodiment, as illustrated in FIG. 1, the upper 2 includes the upper main body 20 covering the instep of the foot, and the upper main body 20 is formed with the opening 20*b* provided in a region away from the outer edge 20*c* of the upper main body 20, and a passage 4 formed in a tubular shape that extends from the opening 20*b* toward the outer edge 20*c* and then extends so as to return to the opening 20*b* and allows the shoelace 22 to pass through. With this configuration, the degree of freedom in designing the position of the passage 4 in the upper main body 20 is increased, and the degree of freedom in selecting the portion through which the shoelace 22 passes in the upper main body 20 can be increased. Further, the upper main body 20 can be pulled up from the sole side, that is, the outer edge 20*c* near the joint portion between the upper 2 and the sole 3.

In the present embodiment, since the passage 4 is formed in the upper fore foot portion 23, the upper middle foot portion 24, the upper rear foot portion 25, and the upper sole portion 26, the variation of the route for passing the shoelace 22 increases, so that the portion of the upper main body 20 fastened by the shoelace 22 can be changed.

In the present embodiment, as illustrated in FIG. 2, the upper main body 20 is formed with the communication portions 27 that communicate the inside and the outside of the passage 4, so that the shoelace 22 can be taken in and out of the passage 4.

In the present embodiment, as illustrated in FIG. 2, the upper main body 20 includes the upper middle foot portion 24 that covers the middle foot portion of the foot, and the upper sole portion 26 that is formed continuously with the upper middle foot portion 24 and covers the sole, and the upper middle foot portion 24 is formed with the opening 20*b* extending in the fore-rear direction. Further, a plurality of the communication portions 27 is provided apart from each other in the fore-rear direction at the left and right side edges of the opening 20*b*, and the passage 4 includes the middle foot side passage 41 extending from any one of the plurality of communication portions 27 toward the upper sole portion 26 and then extending to another of the communication portions 27. In such a configuration, since the upper middle foot portion 24 can be lifted from the lower side by allowing the shoelace 22 to pass through the middle foot side passage 41 and to be tensioned, it is possible to achieve a comfortable tightness in which the applied pressure is dispersed. That is, by lifting the upper middle foot portion 24 from the bottom by the shoelace 22, the tightening force by the shoelace 22 is easily uniformly transmitted from the vicinity of the upper sole portion 26 to the opening 20*b* in the upper middle foot portion 24, so that an appropriate tightening feeling can be provided from the vicinity of the sole to the instep of the wearer.

In the present embodiment, as illustrated in FIG. 2, the middle foot side passage 41 includes the lateral foot side passage 45 formed on the lateral foot side with the opening 20*b* interposed therebetween, and the medial foot side passage 46 formed on the medial foot side with the opening 20*b* interposed therebetween. With such a configuration, the right and left side portions of the upper middle foot portion 24 can be lifted from below by the shoelace 22, and thus it is possible to achieve a comfortable tightness in which the applied pressure is dispersed in a well-balanced manner on the right and left sides.

In the present embodiment, since the upper main body 20 is formed by a single material, the upper 2 including the passage 4 can be easily manufactured.

Second Embodiment

Figure 9:
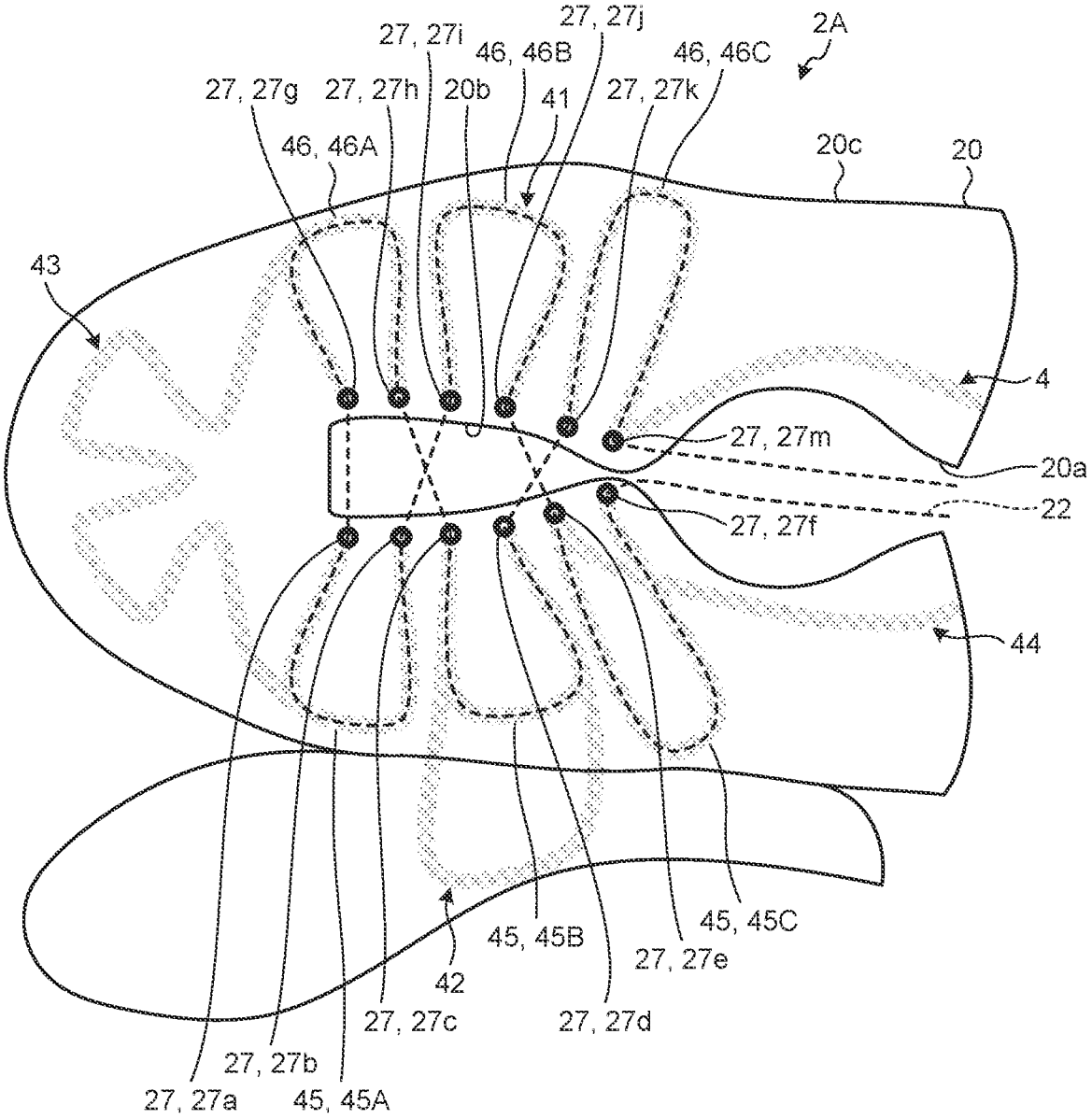
FIG. 9 is a developed view of an upper according to a second embodiment.

FIG. 9 is a developed view of an upper 2A according to a second embodiment. The upper 2A according to the second embodiment is different from the upper 2 according to the first embodiment in the configuration of the communication portions 27. Note that, in the second embodiment, the same reference numerals are given to parts overlapping with the first embodiment described above, and description thereof is omitted.

Both end portions along the length direction of the lateral foot side passage 45 do not extend to the opening 20*b* and are separated from the opening 20*b*. Both end portions along the length direction of the medial foot side passage 46 do not extend to the opening 20*b* and are separated from the opening 20*b*. The communication portions 27 are provided at positions overlapping the both end portions along the length direction of the lateral foot side passage 45 and positions overlapping the both end portions along the length direction of the medial foot side passage 46. In the present embodiment, the communication portions 27 are formed only by an eyelet hole penetrating the upper main body 20 in the vertical direction. The present embodiment can achieve effects similar to those of the first embodiment described above.

Third Embodiment

Figure 10:
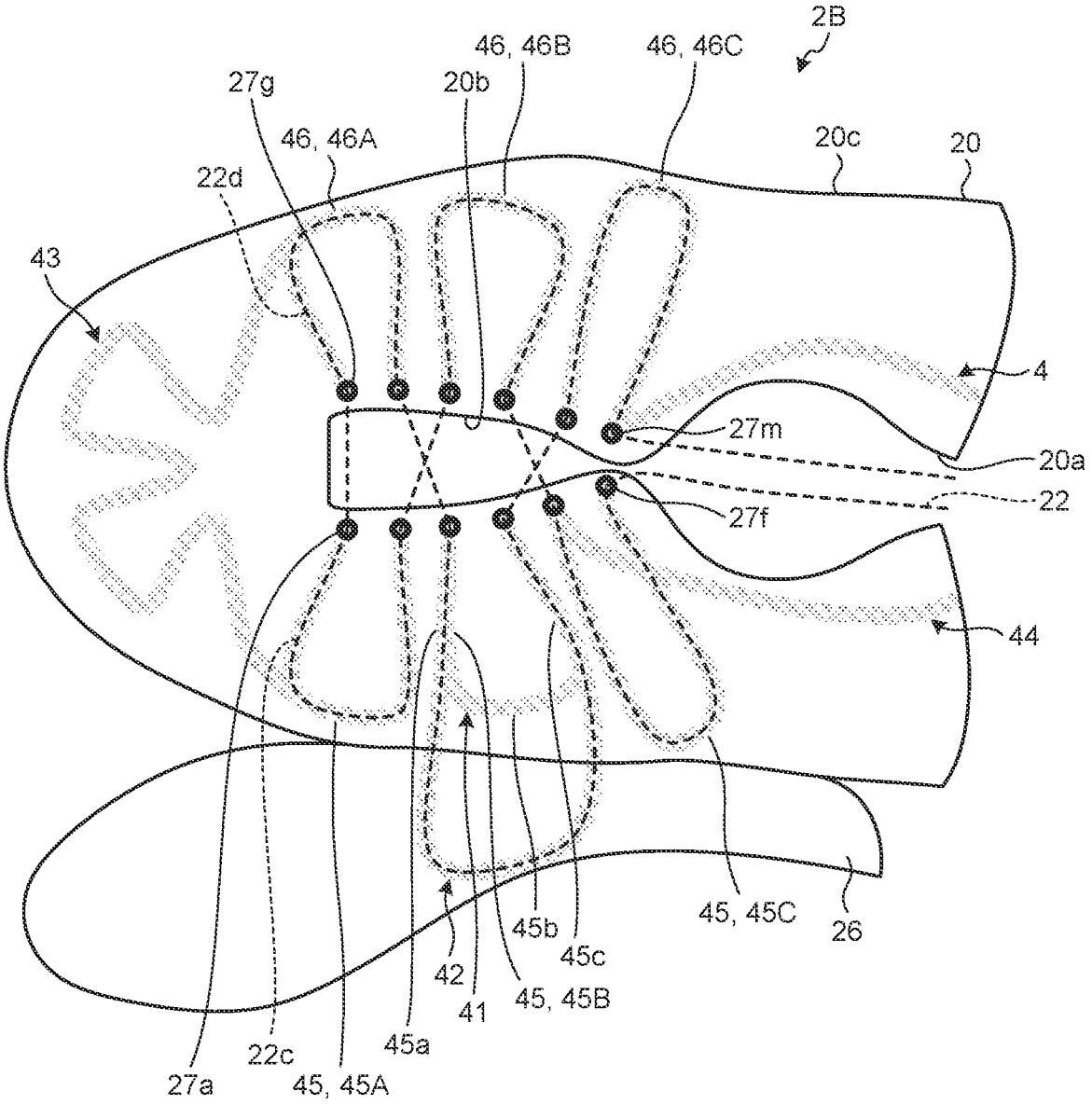
FIG. 10 is a developed view of an upper according to a third embodiment.

FIG. 10 is a developed view of an upper 2B according to a third embodiment. The upper 2B according to the third embodiment is different from the upper 2A according to the second embodiment in the route for passing the shoelace 22. Note that, in the third embodiment, the same reference numerals are given to portions overlapping with the first and second embodiments, and the description thereof is omitted.

In the present embodiment, the shoelace 22 passes through the lateral foot side passages 45, the medial foot side passages 46, and the sole side passage 42. The shoelace 22 includes a first portion 22*c* passing through the lateral foot side passage 45A, the medial foot side passage 46B, and the lateral foot side passage 45C, and a second portion 22*d* passing through the medial foot side passage 46A, the lateral foot side passage 45B, the sole side passage 42, and the medial foot side passage 46C. The second portion 22*d* passes through the first lateral foot side passage 45*a* of the lateral foot side passage 45B, the sole side passage 42, and the third lateral foot side passage 45*c* of the lateral foot side passage 45B in this order, and does not pass through the second lateral foot side passage 45*b*.

One end portion along the length direction of the first portion 22*c* and one end portion along the length direction of the second portion 22*d* are connected to each other between the two communication portions 27*a* and 27*g*. A portion of the first portion 22*c* and a portion of the second portion 22*d* extend in the left-right direction across the opening 20*b*. The portions of the first portion 22*c* and the second portion 22*d* that cross the opening 20*b* are exposed to the outside of the upper main body 20. The other end portion along the length direction of the first portion 22*c* is exposed to the outside of the upper main body 20 from the communication portion 27*f* located rearmost on the lateral foot side. The other end portion along the length direction of the second portion 22*d* is exposed to the outside of the upper main body 20 from the communication portion 27*m* located rearmost on the medial foot side. Although not illustrated, the other end portion along the length direction of the first portion 22*c* and the other end portion along the length direction of the second portion 22*d* are tied in a bow knot or the like.

The present embodiment can achieve effects similar to those of the first and second embodiments described above. In addition, in the present embodiment, the passage 4 includes the sole side passage 42 that extends from the middle foot side passage 41 to the upper sole portion 26 and then extends so as to return to the middle foot side passage 41, and the shoelace 22 is passed through the sole side passage 42, whereby the upper sole portion 26 can be pulled up from below by the shoelace 22, and thus a tightening feeling can also be given to the sole of the wearer. In addition, in the present embodiment, the sole side passage 42 is disposed in the middle foot portion of the upper sole portion 26, so that it is possible to suppress falling of the inner longitudinal arch of the wearer.

Fourth Embodiment

Figure 11:
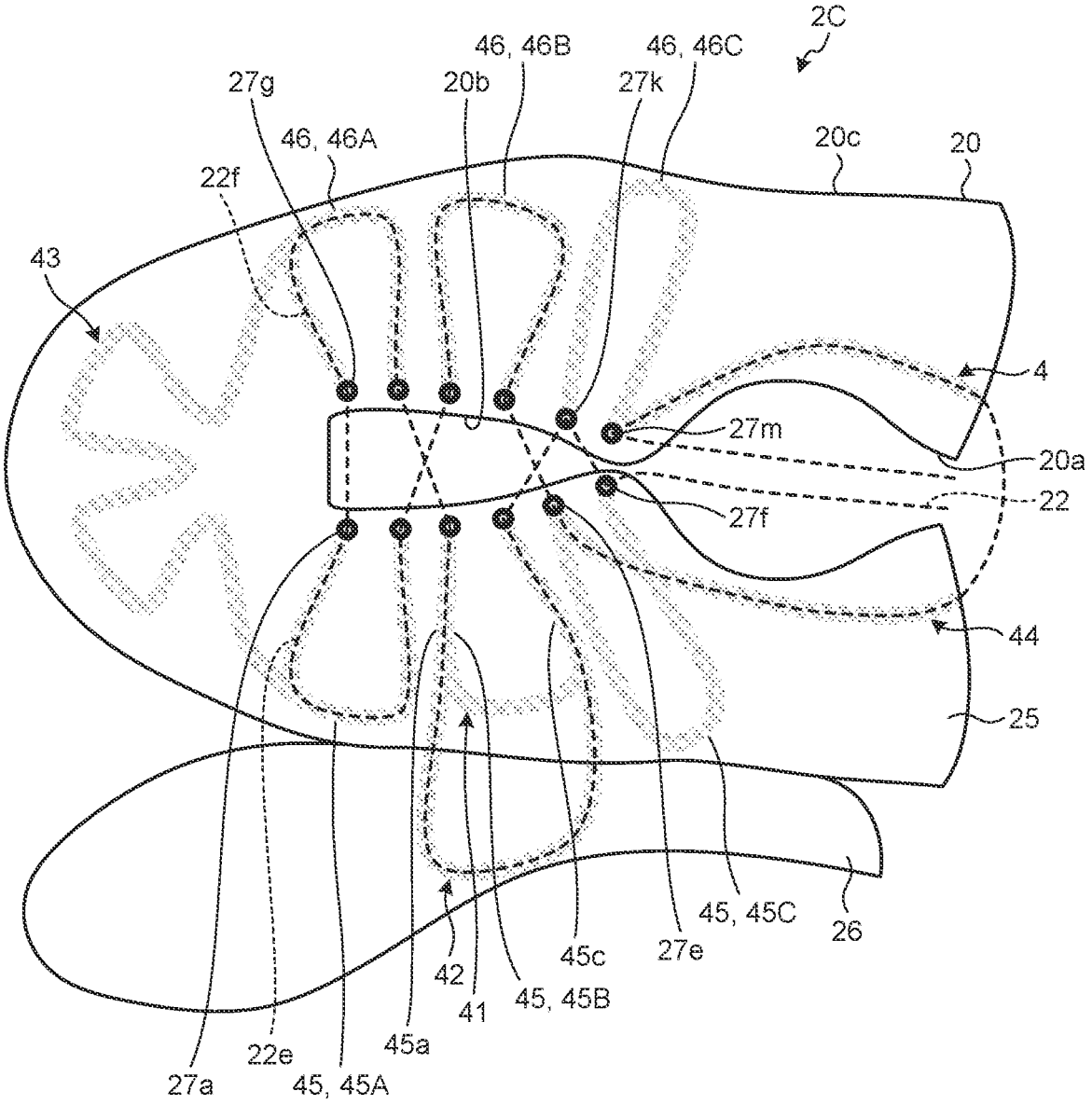
FIG. 11 is a developed view of an upper according to a fourth embodiment.

FIG. 11 is a developed view of an upper 2C according to a fourth embodiment. The upper 2C according to the fourth embodiment is different from the upper 2A according to the second embodiment in the route for passing the shoelace 22. Note that, in the fourth embodiment, the same reference numerals are given to portions overlapping with the first and second embodiments, and the description thereof is omitted.

In the present embodiment, the shoelace 22 passes through a part of the lateral foot side passages 45, a part of the medial foot side passages 46, the sole side passage 42, and the rear foot side passage 44. The shoelace 22 includes a first portion 22*e* that passes through the lateral foot side passage 45A, the medial foot side passage 46B, and the rear foot side passage 44, and a second portion 22*f* that passes through the medial foot side passage 46A, the lateral foot side passage 45B, and the sole side passage 42.

The first portion 22*e* is passed through the lateral foot side passage 45A, the medial foot side passage 46B, the communication portion 27*e*, the rear foot side passage 44, and the communication portion 27*m* in this order. The second portion 22*f* passes through the medial foot side passage 46A, the first lateral foot side passage 45*a* of the lateral foot side passage 45B, the sole side passage 42, the third lateral foot side passage 45*c* of the lateral foot side passage 45B, and the communication portions 27*k* and 27*f* in this order.

One end portion along the length direction of the first portion 22*e* and one end portion along the length direction of the second portion 22*f* are connected to each other between the two communication portions 27*a* and 27*g*. A portion of the first portion 22*e* and a portion of the second portion 22*f* extend in the left-right direction across the opening 20*b*. The portions of the first portion 22*e* and the second portion 22*f* that cross the opening 20*b* are exposed to the outside of the upper main body 20. The other end portion along the length direction of the first portion 22*e* is exposed to the outside of the upper main body 20 from the communication portion 27*m* located rearmost on the medial foot side. The other end portion along the length direction of the second portion 22*f* is exposed to the outside of the upper main body 20 from the communication portion 27*f* located rearmost on the lateral foot side. Although not illustrated, the other end portion along the length direction of the first portion 22*e* and the other end portion along the length direction of the second portion 22*f* are tied in a bow knot or the like.

The present embodiment can achieve effects similar to those of the first to third embodiments described above. In addition, in the present embodiment, the passage 4 includes the rear foot side passage 44 that extends from the middle foot side passage 41 to the upper rear foot portion 25 and then extends so as to return to the middle foot side passage 41, and the shoelace 22 is also passed through the rear foot side passage 44, whereby the upper rear foot portion 25 can be tightened by the shoelace 22, and thus the tightening feeling can also be given to the rear foot portion of the wearer.

Fifth Embodiment

Figure 12:
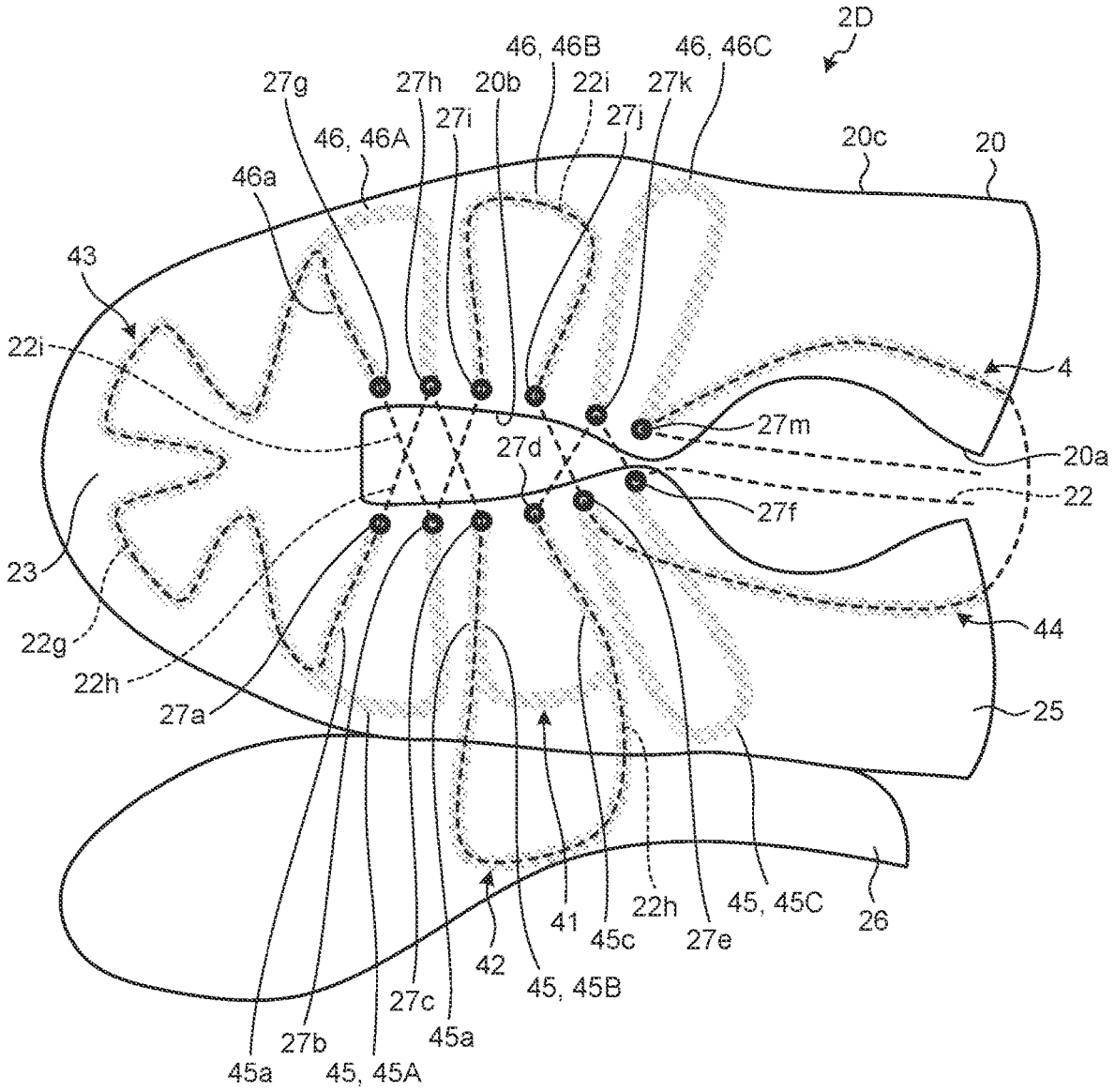
FIG. 12 is a developed view of an upper according to a fifth embodiment.

FIG. 12 is a developed view of an upper 2D according to a fifth embodiment. The upper 2D according to the fifth embodiment is different from the upper 2A according to the second embodiment in the route for passing the shoelace 22. Note that, in the fifth embodiment, the same reference numerals are given to portions overlapping with the first and second embodiments, and the description thereof is omitted.

In the present embodiment, the shoelace 22 passes through the fore foot side passage 43, a part of the lateral foot side passages 45, a part of the medial foot side passages 46, the sole side passage 42, and the rear foot side passage 44. The shoelace 22 includes a first portion 22*g* passing through the fore foot side passage 43, the lateral foot side passage 45A, and the medial foot side passage 46A, a second portion 22*h* passing through the lateral foot side passage 45B and the sole side passage 42, and a third portion 22*i* passing through the medial foot side passage 46B and the rear foot side passage 44.

The first portion 22*g* passes through the fore foot side passage 43, the first lateral foot side passage 45*a* of the lateral foot side passage 45A, and the first medial foot side passage 46*a* of the medial foot side passage 46A.

The second portion 22*h* passes through the communication portions 27*a*, 27*h*, and 27*c*, the first lateral foot side passage 45*a* of the lateral foot side passage 45B, the sole side passage 42, the third lateral foot side passage 45*c* of the lateral foot side passage 45B, and the communication portions 27*d*, 27*k*, and 27*f* in this order.

The third portion 22*i* is passed through the communication portions 27*g*, 27*b*, and 27*i*, the medial foot side passage 46B, the communication portions 27*j* and 27*e*, the rear foot side passage 44, and the communication portion 27*m* in this order.

One end portion along the length direction of the second portion 22*h* and one end portion along the length direction of the third portion 22*i* are connected to the first portion 22*g*. A portion of the second portion 22*h* and a portion of the third portion 22*i* extend in the left-right direction across the opening 20*b*. The portions of the second portion 22*h* and the third portion 22*i* that cross the opening 20*b* are exposed to the outside of the upper main body 20. The other end portion along the length direction of the second portion 22*h* is exposed to the outside of the upper main body 20 from the communication portion 27*f* located rearmost on the lateral foot side. The other end portion along the length direction of the third portion 22*i* is exposed to the outside of the upper main body 20 from the communication portion 27*m* located rearmost on the medial foot side. Although not illustrated, the other end portion along the length direction of the second portion 22*h* and the other end portion along the length direction of the third portion 22*i* are tied in a bow knot or the like.

The present embodiment can achieve effects similar to those of the first to fourth embodiments described above. In addition, in the present embodiment, the passage 4 includes the fore foot side passage 43 that extends from the middle foot side passage 41 to the upper fore foot portion 23 and then extends so as to return to the middle foot side passage 41, and the shoelace 22 is also passed through the fore foot side passage 43, whereby the upper fore foot portion 23 can be tightened by the shoelace 22, and thus the tightening feeling can also be given to the fore foot portion of the wearer.

Sixth Embodiment

Figure 13:
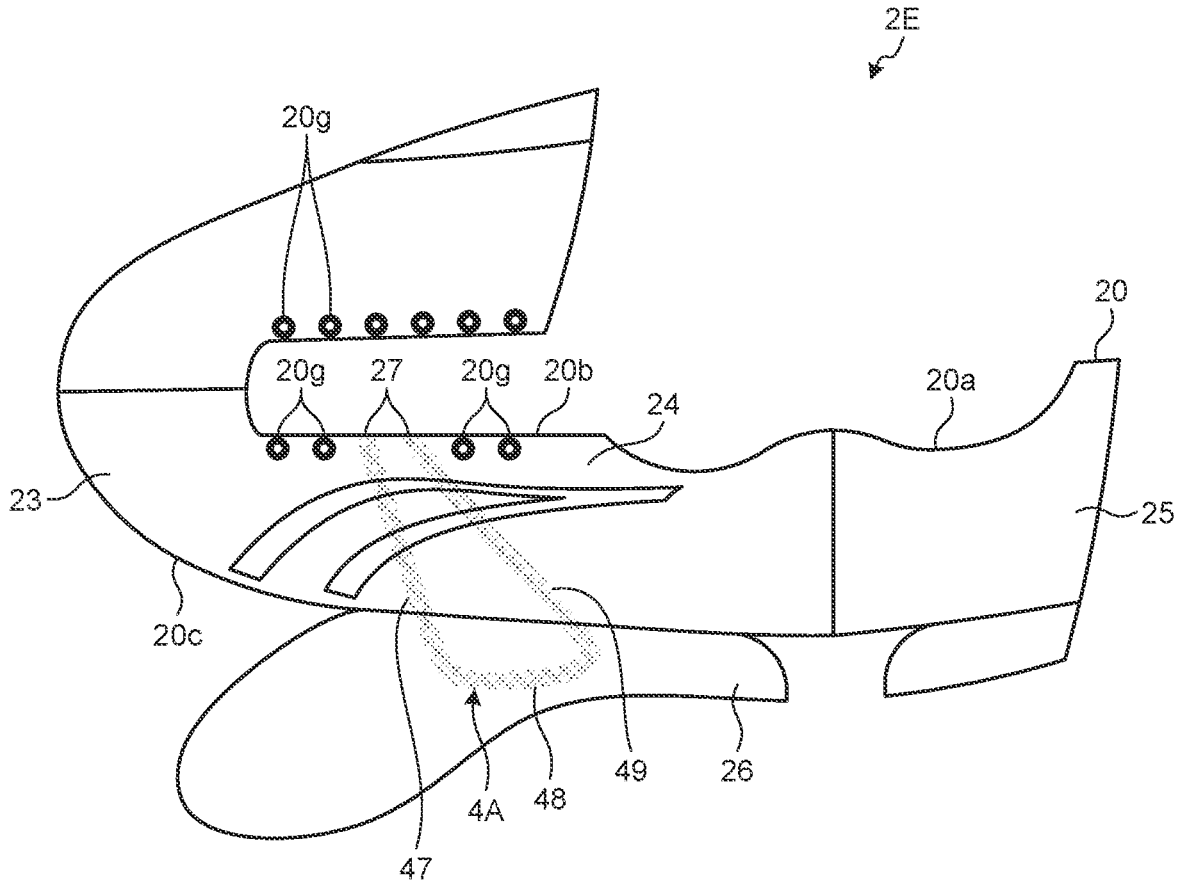
FIG. 13 is a developed view of an upper according to a sixth embodiment.

FIG. 13 is a developed view of an upper 2E according to a sixth embodiment. The upper 2E according to the sixth embodiment is different from the upper 2 according to the first embodiment in that the number of passages 4A is one. A plurality of passages may be provided as in the first to fifth embodiments, or a single passage may be provided as in the present embodiment. In FIG. 13, illustration of the shoelace 22 is omitted. Note that, in the sixth embodiment, the same reference numerals are given to portions overlapping with the first embodiment described above, and description thereof is omitted.

The passage 4A is formed on the lateral foot side of the opening 20*b*. The passage 4A is a passage that extends from any one of the plurality of communication portions 27 toward the upper sole portion 26 and then extends to another of the communication portions 27. The passage 4A extends in a substantially U shape. The passage 4A includes a first passage 47 extending from one communication portion 27 to the upper sole portion 26, a second passage 48 extending rearward from an end portion of the first passage 47 positioned at the upper sole portion 26, and a third passage 49 extending from a rear end portion of the second passage 48 toward the opening 20*b* to another communication portions 27.

The third passage 49 is connected to the communication portion 27 immediately behind the communication portion 27 connected to the first passage 47. That is, the passage 4A connects the two communication portions 27 adjacent to each other in the front-back direction. A portion of the first passage 47 and a portion of the third passage 49 extend in the vertical direction in the upper middle foot portion 24. A remaining portion of the first passage 47 and a remaining portion of the third passage 49 extend in the left-right direction at the upper sole portion 26. The second passage 48 extends in the front-back direction at the upper sole portion 26. A portion of the passage 4A formed in the upper sole portion 26 is disposed in the middle foot portion of the upper sole portion 26. In the upper main body 20, a plurality of eyelet holes 20*g* is formed at left and right side edges of the opening 20*b* at intervals in the front-back direction. The eyelet hole 20*g* formed at the outer foot side edge is provided in front of and behind the passage 4A.

The present embodiment can achieve effects similar to those of the first embodiment described above. Note that the communication portion 27 is formed by extending the passage 4A to the opening 20*b* in the present embodiment, but may be an eyelet hole provided at a position overlapping both end portions along the length direction of the passage 4A.

Seventh Embodiment

Figure 14:
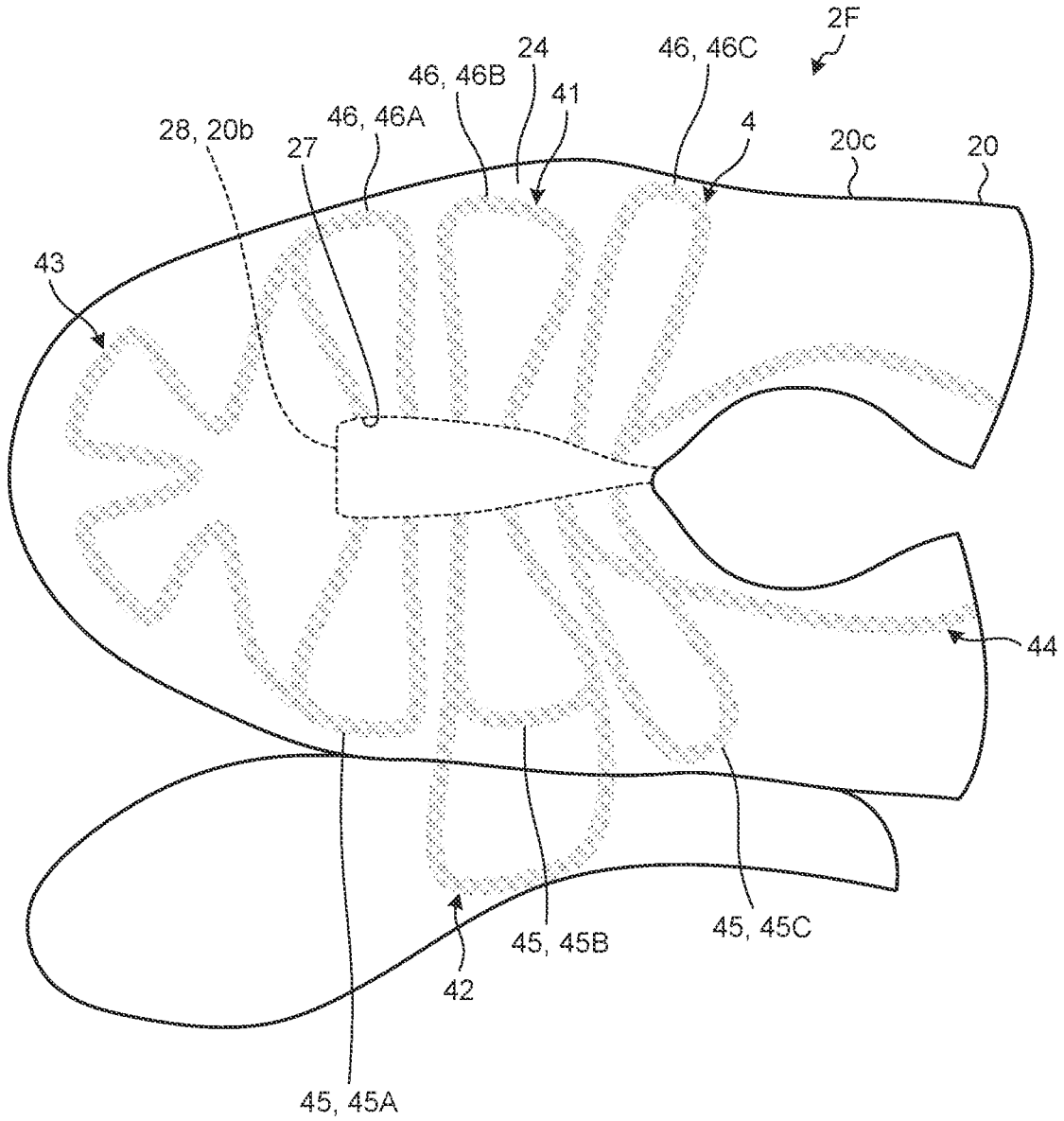
FIG. 14 is a developed view of an upper according to a seventh embodiment.

FIG. 14 is a developed view of an upper 2F according to a seventh embodiment. The upper 2F according to the seventh embodiment is different from the upper 2 according to the first embodiment in that the opening 20*b* is not provided. Note that, in the seventh embodiment, the same reference numerals are given to portions overlapping with the first embodiment described above, and description thereof is omitted.

In the present embodiment, it is assumed that the upper 2 without the opening 20*b* is distributed on the market, and a partial region 28 is cut in the distribution process to form the opening 20*b*. In FIG. 14, the outer edge of the partial region 28 is indicated by a broken line for easy understanding. Since the shoelace 22 does not pass through the passage 4 before cutting, the shoelace 22 is not illustrated in FIG. 14. The upper main body 20 is formed with the partial region 28 that is a region away from the outer edge 20*c* of the upper main body 20, and a passage 4 formed in a tubular shape that extends from the partial region 28 toward the outer edge 20*c* and then extends so as to return to the partial region 28 and allows the shoelace 22 to pass through. The partial region 28 is provided in a part of the upper middle foot portion 24. The partial region 28 extends in the fore-rear direction at the center in the left-right direction of the upper middle foot portion 24.

By cutting the partial region 28, the opening 20*b* illustrated in FIG. 2 can be formed. Thus, a part of the passage 4 without the third layer 20*f* communicates with the opening 20*b*, and the communication portions 27 are formed in the upper main body 20, so that the shoelace 22 can be taken in and out of the passage 4 through the communicating portions 27.

The configuration described in the above embodiment illustrates an example of the content of the present invention, and can be combined with another known technique, and a part of the configuration can be omitted or changed without departing from the gist of the present invention. The route for passing the shoelace 22 through the passage 4 according to the first to fifth embodiments is not limited to the illustrated example. For example, the shoelace 22 may be passed only through the fore foot side passage 43, the lateral foot side passage 45, and the medial foot side passage 46, or the shoelace 22 may be passed only through the lateral foot side passage 45, the medial foot side passage 46, and the rear foot side passage 44.

One or more of the sole side passage 42, the fore foot side passage 43, and the rear foot side passage 44 among the passages 4 according to the first to fifth and seventh embodiments may be omitted. When the sole side passage 42 is omitted, the upper sole portion 26 may be omitted. Further, the position and shape of the passage 4 are not limited to the illustrated example, and may be appropriately changed according to a portion of the upper main body 20 desired to be tightened by the shoelace 22. In addition, in the first to seventh embodiments, the upper main body 20 is formed by a single material, but the upper main body 20 may be formed by combining a plurality of materials. Further, in the first to seventh embodiments, the case where the upper main body 20 has a three-layer structure including the first layer 20*d*, the second layer 20*e*, and the third layer 20*f* has been exemplified, but the upper main body 20 may have a single-layer structure or a plurality of structures other than three layers.

REFERENCE SIGNS LIST

1 SHOE
2, 2A, 2B, 2C, 2D, 2E, 2F UPPER
3 SOLE
4, 4A PASSAGE
20 UPPER MAIN BODY
20*a* FOOT INSERTION OPENING
20*b* OPENING
20*c* OUTER EDGE
20*d* FIRST LAYER
20*e* SECOND LAYER
20*f* THIRD LAYER
20*g* EYELET HOLE
21 SHOE TONGUE
22 SHOELACE
22*a*, 22*c*, 22*e*, 22*g* FIRST PORTION
22*b*, 22*d*, 22*f*, 22*h* SECOND PORTION
22*i* THIRD PORTION
23 UPPER FORE FOOT PORTION
24 UPPER MIDDLE FOOT PORTION
25 UPPER REAR FOOT PORTION
26 UPPER SOLE PORTION
27, 27*a*, 27*b*, 27*c*, 27*d*, 27*e*, 27*f*, 27*g*, 27*h*, 27*i*, 27*j*, 27*k*, 27*m* COMMUNICATION PORTION
28 PARTIAL REGION
30 OUTSOLE
30*a* GROUND CONTACT SURFACE

31 MIDSOLE
41 MIDDLE FOOT SIDE PASSAGE
42 SOLE SIDE PASSAGE
42*a* FIRST SOLE SIDE PASSAGE
42*b* SECOND SOLE SIDE PASSAGE
42*c* THIRD SOLE SIDE PASSAGE
43 FORE FOOT SIDE PASSAGE
43*a* FIRST FORE FOOT SIDE PASSAGE
43*b* SECOND FORE FOOT SIDE PASSAGE
43*c* FIRST PARTIAL PASSAGE
43*d* SECOND PARTIAL PASSAGE
43*e* THIRD PARTIAL PASSAGE
44 REAR FOOT SIDE PASSAGE
45, 45A, 45B, 45C LATERAL FOOT SIDE PASSAGE
45*a* FIRST LATERAL FOOT SIDE PASSAGE
45*b* SECOND LATERAL FOOT SIDE PASSAGE
45*c* THIRD LATERAL FOOT SIDE PASSAGE
46, 46A, 46B, 46C MEDIAL FOOT SIDE PASSAGE
46*a* FIRST MEDIAL FOOT SIDE PASSAGE
46*b* SECOND MEDIAL FOOT SIDE PASSAGE
46*c* THIRD MEDIAL FOOT SIDE PASSAGE
47 FIRST PASSAGE
48 SECOND PASSAGE
49 THIRD PASSAGE
C SHOE CENTER AXIS

The invention claimed is:

1. An upper comprising:

an upper main body adapted to cover an instep of a foot, wherein the upper main body includes:

a partial region that is a region away from an outer edge of the upper main body; and a passage formed in a tubular shape, the passage extending from the partial region toward the outer edge and then extending so as to return to the partial region so that a shoelace is allowed to pass through the passage, wherein the upper main body includes an upper middle foot portion adapted to cover a middle foot portion of the foot, wherein the partial region is provided in a part of the upper middle foot portion, wherein an opening extending in a front-back direction is formed in the partial region, wherein the passage extends from the opening toward the outer edge and then extends so as to return to the opening, wherein in the upper main body, a communication portion that communicates an interior and an exterior of the passage is formed, wherein the upper main body includes an upper sole portion that is formed continuously with the upper middle foot portion and covers a sole, wherein a plurality of the communication portions is provided apart from each other in the front-back direction at a side edge of the opening, wherein the passage includes a middle foot side passage that extends from any one of the plurality of the communication portions toward the upper sole portion and then extends to another of the communication portions, and wherein the passage includes a sole side passage that extends from the middle foot side passage to the upper sole portion and then extends so as to return to the middle foot side passage.

2. The upper according to claim 1, wherein the middle foot side passage includes a lateral foot side passage formed on a lateral foot side with the opening interposed therebetween and a medial foot side passage formed on a medial foot side with the opening interposed therebetween, and the sole side passage extends from the lateral foot side passage to the upper sole portion and then extends so as to return to the lateral foot side passage.

3. The upper according to claim 1, wherein the sole side passage is disposed in a middle foot portion of the upper sole portion.

4. The upper according to claim 1, wherein the upper main body includes an upper front foot portion formed continuously with the upper middle foot portion and adapted to cover a front foot portion of the foot, and the passage includes a front foot side passage that extends from the middle foot side passage to the upper front foot portion and then extends so as to return to the middle foot side passage.

5. The upper according to claim 1, wherein the upper main body includes an upper rear foot portion formed continuously with the upper middle foot portion and adapted to cover a rear foot portion of the foot, and the passage includes a rear foot side passage that extends from the middle foot side passage to the upper rear foot portion and then extends so as to return to the middle foot side passage.

6. The upper according to claim 1, wherein the upper main body is formed by a single material.

7. A shoe comprising: the upper according to claim 1; and a sole located below the upper.

* * * * *